US009356358B2

(12) United States Patent
Chang et al.

(10) Patent No.: US 9,356,358 B2
(45) Date of Patent: May 31, 2016

(54) ARCHITECTURES AND METHODS FOR NOVEL ANTENNA RADIATION OPTIMIZATION VIA FEED REPOSITIONING

(75) Inventors: Donald C. D. Chang, Thousand Oaks, CA (US); Michael T. S. Lin, Chatsworth, CA (US); Eric Hu, Chatsworth, CA (US)

(73) Assignee: SPATIAL DIGITAL SYSTEMS, INC., Camarillo, CA (US)

( * ) Notice: Subject to any disclaimer, the term of this patent is extended or adjusted under 35 U.S.C. 154(b) by 1250 days.

(21) Appl. No.: 12/851,011

(22) Filed: Aug. 5, 2010

(65) Prior Publication Data

US 2011/0032173 A1 Feb. 10, 2011

Related U.S. Application Data

(60) Provisional application No. 61/273,502, filed on Aug. 5, 2009.

(51) Int. Cl.

| | |
|---|---|
| ***H01Q 1/08*** | (2006.01) |
| ***H01Q 19/10*** | (2006.01) |
| ***H01Q 3/04*** | (2006.01) |
| ***H01Q 3/06*** | (2006.01) |
| ***H01Q 19/13*** | (2006.01) |

(52) U.S. Cl.

CPC ..... *H01Q 19/10* (2013.01); *H01Q 3/04* (2013.01); *H01Q 3/06* (2013.01); *H01Q 19/132* (2013.01)

(58) Field of Classification Search

USPC ..... 600/443, 437; 343/880, 778, 754, 786, 343/876, 853; 342/372, 373; 375/259, 340, 375/295

See application file for complete search history.

(56) References Cited

U.S. PATENT DOCUMENTS

| | | | | |
|---|---|---|---|---|
| 5,440,308 | A | 8/1995 | Dybdal | |
| 5,739,788 | A | 4/1998 | Dybdal | |
| 6,137,451 | A | 10/2000 | Durvasula | |
| 6,320,540 | B1 * | 11/2001 | Meredith | 342/377 |
| 6,414,646 | B2 | 7/2002 | Luh | |
| 6,633,744 | B1 | 10/2003 | Howell | |
| 6,844,854 | B2 | 1/2005 | Johnson | |
| 2005/0004464 | A1 * | 1/2005 | Miller | 600/443 |
| 2008/0150826 | A1 * | 6/2008 | Kim | 343/840 |

OTHER PUBLICATIONS

H.T. Chou, W. Theunissen, P.H. Pathak; "Acceleration on the Synthesis of Shaped Reflector Antennas for Contoured Beam Applications via Gaussian Beam Approach," IEEE Antennas and Propagation Society and International Symposium, Aug. 1999.

(Continued)

*Primary Examiner* — Sue A Purvis
*Assistant Examiner* — Jae Kim

(57) ABSTRACT

An antenna system comprises: multiple antenna elements; and multiple beam forming networks configured to produce radiation patterns for both receiving and transmission functions configured to be optimized by re-positioning said antenna elements, wherein said beam forming networks comprise a receiving beam forming network configured to combine multiple first inputs from said antenna elements into at least a first output, and a transmission beam forming network configured to divide a second input into multiple second outputs to said antenna elements.

19 Claims, 13 Drawing Sheets

*An on board multi-beam array*
*beam shaping via element positioning*

(56) References Cited

OTHER PUBLICATIONS

H.-H. Chou, H.-T. Chou, "Fast Sdm for Shaped Reflector Antenna Sybthesis Via Patch Decompositions in Po Integrals;" Progress in Electromagnetics Research; PIER V. 92; 361-375; 2009.

S.L. Avila, W.P. Carpes Jr., J.R. Bergmann; "Satellite Reconfigurable Contour Beam Reflector Antennas by Multi-objective Evolutionary Optimization;" Journal of Microwaves, Optoelectronics and Electromagnetic Applications; V. 7 No. 2; Dec. 1998.

* cited by examiner

Geometry for arrays

Optimization architecture

*An on board array Antenna beam shaping via element positioning*

*An on board dish antenna with defocused array feeds beam shaping via element positioning*

An on board multi-beam array beam shaping via element positioning

*A multi-beam dish antenna with defocused array feeds beam shaping via element positioning*

Remote beam forming techniques

Additional movable elements for better beam shaping

Reflector arrays generating multiple simultaneous beams
*with minimum mutual interference via spatial isolations*

Mobile VSAT terminals
*with gimbaled dishes combined by DBF*

DTH terminals with Multi-aperture

*with re-position dishes combined by BFN*

VSAT terminals with Multi-aperture

*with re-position dishes combined by BFN*

Predicted far field patterns

*for a multi-reflector array antenna*

VSAT terminals with Multi-aperture

*with re-position dishes combined by BFN*

ARCHITECTURES AND METHODS FOR NOVEL ANTENNA RADIATION OPTIMIZATION VIA FEED REPOSITIONING

RELATED APPLICATION DATA

This application claims the benefit, pursuant to 35 U.S.C. §119(e), of U.S. provisional application Ser. No. 61/273,502 filed on Aug. 5, 2009.

REFERENCES

1. U.S. Pat. No. 6,633,744, "Ground-based satellite communications nulling antenna," James M Howell, Issued on Oct. 14, 2003.
2. U.S. Pat. No. 6,844,854, "Interferometric antenna array for wireless devices,": J. R. Johnson, S L. Myers, Issued date: Jan. 18, 2005
3. U.S. Pat. No. 5,739,788, "Adaptive Receiving Antenna for Beam Repositioning," R. B. Dybdal and S. J. Curry, Issued on April, 1998.
4. U.S. Pat. No. 5,440,306, "Apparatus and Method for Employing Adaptive Interference Cancellation over a Wide Bandwidth," R. B. Dybdal and R. H. Ott, Issued on Aug. 8, 1995.
5. "Acceleration on the synthesis of shaped reflector antennas for contoured beam applications via Gaussian beam approach," H. T. Chou, W. Theunissen, P. H. Pathak, IEEE Antennas and Propagation Society International Symposium, August 1999
6. "Fast Sdm For Shaped Reflector Antenna Synthesis Via Patch Decompositions In Po", H.-H. Chou, H.-T. Chou, Progress In Electromagnetics Research, PIER 92, 361-375, 2009
7. "Satellite Reconfigurable Contour Beam Reflector Antennas by Multi-objective Evolutionary Optimization," S. L. Avila, W. P. Carpes Jr., J. R. Bergmann, Journal of Microwaves, Optoelectronics and Electromagnetic Applications, Vol. 7, No. 2, December 2008
8. U.S. Pat. No. 6,137,451, "Multiple beam by shaped reflector antenna," by B. Durvasula, T M Smith, Publication date: Oct. 24, 2000.
9. U.S. Pat. No. 6,414,646, "Variable beamwidth and zoom contour beam antenna systems," by Howard H. S. Luh, Issued on Jul. 2, 2002.

BACKGROUND OF THE INVENTION

1. Field of the Invention

The present invention relates to antenna architectures and methods on re-configurable antennas via feed re-positioning for various optimized radiation contours, including beam forming (or shaping) and/or null steering on contoured beams, spot beams, and orthogonal beams. The feed re-positioning techniques can also be used in radiation pattern optimization processing during antenna design phases for fixed beams.

2. Description of Related Art

The present invention relates to antenna architectures and methods on re-configurable antennas for all wireless RF communications via feed re-positioning for various optimized radiation contours. The feed re-positioning techniques can also be used in optimizing radiation pattern processing during antenna design phases for fixed beams.

We focus applications on satellite communications on this disclosure. However, similar designs based on same principles are applicable for other RF systems including radars, radiometers, terrestrial point-to-point and point-to-multiple points wireless communications, airborne GPS antennas; just to name a few.

Satellite Ground Terminals

A satellite ground terminal is designed to maintain RF transmission links between itself and a designated satellite while minimizing interference to and from other nearby satellites. In order to maximize orbital space utility, satellites covering the same areas with the same spectrum are kept relatively far from one another—at least 2° apart, enabling satellite operators to reuse the same spectrum independently for the same coverage.

A satellite ground terminal usually comes with a beam forming design constraint that enables the terminal to point in a desired satellite direction with a certain gain. Beam forming is a concept of using interference to change directionality of radio waves to: focus a signal in a desired direction, boost signal strength, and to reduce signal emissions in undesired directions. The corresponding beam-widths from specified antenna apertures are smaller than the spacing among adjacent satellites covering the same areas with the same frequency bands. However, as the number of satellites in the Earth's geo-synchronous orbit increases due to rising demand, the need rises for additional constraints on ground terminals for both transmit and receive functions-beam nulling.

Beam nulling [1, 2, 3, 4] is another feature of beam forming process that manipulates the multiple array antenna elements of a satellite ground terminal in such a way that the spatial combining effects due to propagation path differential minimize the terminal radiation in certain directions within a transmit frequency band. At the same time, beam nulling can also significantly reduce the ground terminal receiving sensitivity in the same (or other) directions within the receiving frequency band, thus helping to resolve the issue of interference from other satellites.

Normally, geostationary orbit (GEO) satellites operating within the same radio wave spectrum or frequencies are placed in orbit 2° apart. This is to reduce interference between satellites for the ground operator, as well as maximizing available satellite resources. If the two adjacent satellites are closely spaced—less than 2°—the proposed ground terminals will enable both operators to reuse the available spectrums independently for the same coverage, maximizing the utility of the available bandwidth. The signal isolations between the two satellite systems are achieved via spatial isolation alone, not by frequency or time diversities. With more than two satellites in close proximity, the proposed terminals have the capability of forming a beam peak in their respective satellite's direction and forming close-in nulls in the directions of the nearby interfering satellites. The angular discriminations on ground terminals are achieved via array element placement.

Satellite Antennas

In a similar fashion to the mobile terminal antenna applications, the mechanical adjustment techniques can be applied very cost effectively to satellite on-board antenna designs. This can give communications satellites occasional coverage re-shaping capability without the need for electronic signal processing.

Current inventions are designed for satellite antenna architectures with multiple feeds, including direct radiating arrays, magnified phased arrays, and defocused multiple-beam antennas (MBA's). On the other hand, the beam shaping or reconfigurable mechanisms are via re-positioning of array feeds of an antenna. The repositioning includes (1) linear translations of feed elements in a, y, and z directions, (2) feed element rotations through the element center and parallel to x, y, and z axes, and (3) combinations of (1) and (2).

In addition, commercial satellite services sometimes call for contour beam shaping, which utilizes a specially shaped reflector surface to cover desired coverage areas [5, 6]. There are techniques to have one common shaped reflector with multiple switching feeds for a few "re-configurable" coverage areas [7, 8, 9]. However, these coverage areas must be determined during the design phase as the reflector shape must be manufactured under the constraints of known potential coverage areas. Each area is by a designated feed or a combination of a set of designated feeds. Variable area coverage is achieved via switching to different feeds or different sets of feeds.

The design process may be based on computer simulations or actual range measurements via performance optimizations, and the associated performance constraints will be set for single beam or multiple beams, and for single frequency band or multiple frequency bands.

The optimization process may also be tested and utilized with antenna farm integration in mind, minimizing mutual interferences and cross polarizations among various reflectors antennas for both receive (Rx) and transmit (Tx) functions by repositioning of reflectors antennas or auxiliary feeds. Then, the feeds may be configured as directed radiation elements or defocused feeds to reflectors.

SUMMARY OF THE INVENTION

The present invention relates to satellite and ground terminal antenna architectures and wireless communications, specifically satellite and ground terminal based communications. Specifically, the present invention provides a dynamic method and design of using a dynamic antenna array system to utilize beam forming, null shaping, and feed repositioning as an elegant solution to: overlapping GEO satellite-based interference, a cost effective method to complex satellite antenna design.

Using amplitude tapering and phase-shifting (or equivalently I/Q tapering) to form beams with desired radiation patterns are widely known techniques for both multi-beam antennas (MBAs) and phased array antennas (PAAs). Most applications use electronic, electromagnetic (EM) or mechanical phase shifters and amplitude attenuators (or equivalently I/Q weighting) connected in-line to the transmission lines delivering signals to and from multiple radiating elements of an antenna. Typically, each element signal is phase-shifted and amplitude attenuated (or weighted) differently to control radiation patterns, shaping the patterns into desired contours.

Fixed Satellite Communications (Satcom) Terminals using Arrays with Repositioning Capability One such example is for satellite communications applications. Ground terminal antenna configurations feature multiple reflectors (or dishes) aligned linearly in the direction locally parallel to the geo-synchronous arc near a target satellite for the rejection of interference to and from a close-in satellite operated in the same frequency band. The dishes (reflectors) are interconnected by various beam forming networks (BFN) to function as both transmit and receive arrays for multiple beams.

Our approach achieves the desired radiation patterns for both transmit and receive functions by altering the spacing among the interconnected multiple antenna dishes. When the repositioning processing converges and the reflector element locations are optimized, there will be multiple Rx or Tx orthogonal beams generated by the reflector array. As a result, each beam features a beam peak at a desired satellite direction respectively, with specified nulls at other satellite directions.

For geostationary earth orbits (GEO), the satellite position will stay fixed in the sky, requiring only an initial setup of the antenna array positioning.

We shall focus this disclosure on the GEO case. Those familiar with satellite communications can convert the terminal configurations of GEO applications to those for the non-GEO applications.

For this example, there are two communications satellite systems operating in GEO orbit separated by 0.5 degrees, and covering different service areas using the same frequency band. The two coverage areas are not overlapped but adjacent to one another. However, both satellites feature radiation patterns with high spillover to the coverage areas of the other satellite system.

The angular separation between the two satellites is too small for conventional terminals to function adequately. Conventional terminals are capable of generating beams with beamwidth small enough to separate satellites with spacing ~2° or larger.

The antennas from both space and ground assets are not adequate to provide enough directional isolation between the two satellite systems. In order to avoid interferences from one another, the two satellites must operate on 50% of the total capacity, either using a time sharing basis or a frequency sharing basis, because the same spectrum can only be used once by the two combined satellite systems. Each satellite system operator loses roughly 50% of potential revenues.

It is possible to use the multi-aperture terminals providing adequate isolations among the two satellite systems using spatial isolation, enabling the two satellite systems to fully utilize the same spectrum simultaneously and independently. Terminal antennas with multiple apertures can be oriented so that the GEO satellites are separated in the azimuth direction of the array terminals. The ground terminal features four reflector elements with a position optimization capability. The simulated results illustrate the capability of forming nulls and beam peaks concurrently for both Tx and Rx by optimizing the reflector positions.

Radiation patterns of multi-aperture terminals can be controlled by electronic amplitude attenuators and phase shifters or I/Q weighting circuits. They are available to the operator but cost more. Using antenna element positioning to form directional beams and nulls would be an alternative to achieve the same goal but with reduced costs for ground terminals.

Mobile Satcom Platform

Another application is about using a sparse array for satellite communication (SatCom) terminal antenna applications on moving platforms. It is possible to use the satellite terminal for low earth orbits (LEO), medium earth orbits (MEO), and other non GEO orbits in which the satellite positions and directions relative to ground stations will vary over time. The antenna elements may be mounted on rails and equipped with controlled motors. The array element spacing among the reflectors can then be dynamically adjusted accordingly, when the satellite's position changes in certain orbits.

The array elements are small dishes, flat panels, or subarrays. They may not be identical, but will be mounted individually and mechanically gimbaled independently to adjust the element field-of-views (FOVs) aligned to the desired satellites. The array elements are then combined coherently by digital beam forming (DBF) to form a beam at a desired direction and steering nulls to prescribed directions of nearby satellites. The moving platforms may be ground based or airborne.

The array geometry and the Tx DBF with the optimized Tx BFN do assure the Tx radiation pattern featuring the desired peak and nulls at prescribed directions properly, provided the multiple Tx channels are "balanced" in amplitudes and phases. There are needs for continuous calibration circuits to assure:

a. the array geometry are accurately known, and b. the multiple Tx channels are accurately calibrated.

A calibration network with 4 additional Rx-only elements can be devised to calibrate the gimbaled element positions and amplitude and phase variations among the elements via cross-correlation techniques.

By changing the array geometry, both Rx and Tx patterns of the array will be altered. On the other hand, the array element positions are optimized to achieve a prescribed shaped beam with (1) desired far field constraints, (2) an optimization program, and (3) diagnostic information on precision predictions or measurements of the array performance.

By changing the relative positions of the reflectors, both Rx and Tx patterns of the array will be altered. On the other hand, the reflector positions are optimized to achieve prescribed isolations among the four beams with (1) desired far field constraints on sidelobe levels and falloff rates, (2) an optimization program, and (3) diagnostic information on precision predictions or measurements of the reflector array performances.

Moreover, the beam shaping of multiple contour beams can also be achieved via iterative two step optimizations: (1) simultaneously shaping multiple coverage beams via modifications of all reflector profiles instead of shaping a single coverage beam via modifications of a reflector profile, and (2) perturbing the relative positions of the reflectors. The constraints for shaping are global and identical.

Satellite Antenna Contour Coverage Adjustments in an Inclined Orbit

For geostationary earth orbits (GEO), the satellite position will stay fixed in the sky, requiring only an initial setup of the antenna array positioning. On the other hand, it is possible to place a satellite in inclined GEO orbits with small inclined angles in which the satellite positions and directions relative to ground stations will vary over a 24 hour period.

The satellite antenna geometries may be direct radiating elements, magnified phased arrays, or defocused multi-beam antennas (MBA). The beams forming processing are results of two mechanisms: one from conventional BFN's and the other of element repositioning. The BFN may be either analog or digital.

The positions of array feed elements of the reflector can be dynamically adjusted accordingly to the satellite's position changes in a slightly inclined orbit covering the same areas on earth.

We shall focus this disclosure on reconfiguration of the radiation pattern in near GEO case. Those familiar with satellite communications can convert the configurations of GEO applications to those for the non-GEO applications.

A defocused MBA antenna consists of an offset parabolic reflector and a feed array located away from the focal plane. There are many array elements randomly distributed for both transmit (Tx) and receive (Rx) functions. However the feed array may or may not be on the focal plane at all. Individual array feeds featuring secondary patterns when radiated on to the far field through the reflector geometry have associated field-of-views (FOVs) which are largely disjointed. When the array feeds are located on focal planes, the overlapped portions of individual FOVs in the far field are relatively small, especially for those feeds near the focus. The overlapped portions of FOVs among adjacent feeds increase when the feeds are away from the focus. On the other hand, when the arrays feeds are further away from the focal plane, the overlapped portions grow accordingly.

We assume that each element is connected by a diplexer separating the Rx and Tx frequency bands. The elements are movable by the position drivers, controlled by beam controllers on a ground control facility. The controller has access to radiation pattern optimization/tracking processor. In Rx, signals collected by an element, after the diplexer, are amplified by low noise amplifiers (LNAs), and then combined with other elements by a Rx BFN (or a summer), a combining mechanism with a fixed amplitude and phase (or I/Q) adjustment. The optimized array geometry with the fixed BFN on a satellite assures the Rx pattern to cover the service area properly according to the satellite locations and pointing direction of the antenna. The combined signals, or the output of the Rx BFN, are filtered, amplified, and then frequency translated to the corresponding a Tx frequency slot.

In Tx, the bent-pipe signals are divided into multiple elements via a fixed Tx BFN, each filtered and then amplified by a solid state power amplifier (SSPA). The Tx BFN provides the proper amplitude and phase (or I/Q) modifications to the signals for individual elements. The array geometry with the fixed Tx BFN assures the Tx radiation pattern cover the service area properly. The amplified signals are then put through the diplexer to the individual elements. The radiated signals from various elements are combined in the far field. Only those users inside the coverage area are accessible to the radiated signals.

By changing the array geometry, both Rx and Tx patterns of the array will be altered. On the other hand, the array element positions are optimized to achieve a prescribed shaped beam with (1) desired far field constraints, (2) an optimization program, and (3) diagnostic information on precision predictions or measurements of array performance.

In addition, multiple shaped beams can also be generated via element repositioning by repeating the circuitries in between the LNAs and the SSPAs or HPAs (high power amplifiers). There are two sets of independent BFNs for two shaped beams. They are orthogonal to each other in order to preserve the beam shaping efficiency for two concurrent beams with good isolations.

DETAILED DESCRIPTION OF THE PREFERRED EMBODIMENT

Figure 1:
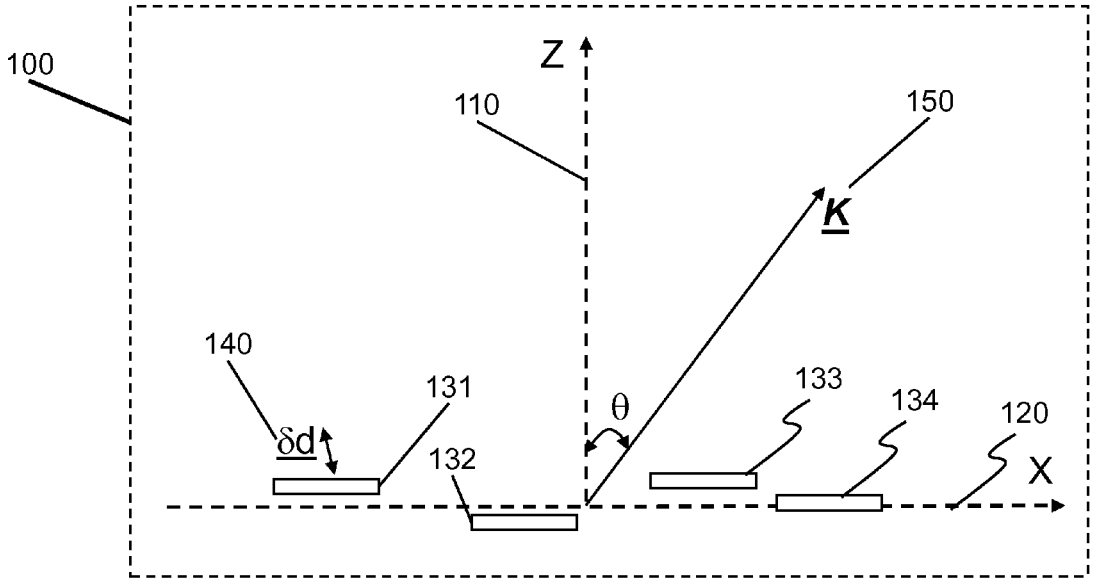
FIG. 1 depicts a coordinate system for element repositioning for array antennas; effects of element displacement and rotations with respect to propagation directions.

Mechanical feed position adjustment techniques can be applied in a cost effective manner to many antenna designs for reconfigurable coverage in various applications. In this disclosure, we list 6 different applications related to satellite communications. However, the same techniques can be utilized in many applications, including but with no limitation thereto, cell phone base stations, terrestrial point-to-point connectivity, point-to-multi-point connectivity, two way ground to air and air to ground communications links.

The present invention may perform any of the following functions for an antenna on satellites via feed repositioning:

1. Shaping the antenna radiation pattern for either transmit or receive beams to prescribed contours covering a service area.
2. Shaping the antenna radiation pattern for both transmit and receive beams to prescribed contours covering a service area.
3. Configurability; to re-shape the radiation pattern to various contours covering different service areas.
4. Configurability; to continuously re-shape the radiation pattern to various contours covering same service areas from a slightly inclined orbit.
5. Enhancing isolations of simultaneous multiple shaped beams with coverage areas adjacent to one another.

For ground terminals for satellite communications, the present invention may perform any of the following functions for an antenna via feed repositioning:

1. Creating simultaneous multiple beams with prescribed beam and null positions for fixed and mobile applications.
2. Configurability; to re-shape the radiation pattern to link to different satellites.
3. Enhancing isolations of simultaneous multiple spot beams with relay satellites adjacent to one another.

The capacities for satellite antennas with ground based beam forming (GBBF) or remote beam forming (RBF) are limited mainly by channel bandwidths of feeder links. The invention enables additional beam shaping mechanisms on satellite antennas without requirements of additional bandwidths in feeder-links. It may perform any of the following functions for an antenna:

1. Creating simultaneous multiple beams with prescribed beam and null positions for fixed and mobile applications using both electronic weighting, and element positioning on individual elements.
2. Creating simultaneous multiple beams with prescribed beam and null positions for fixed and mobile applications using both electronic weighting, and element positioning on subarrays made by combinations of fixed and movable subarray elements.
3. Configurability; to re-shape the radiation pattern.

Re-positioning an element for an array antenna is similar to phase shifting on an array element. The phase shifting due to element repositioning is not "omni-directional" but direction-arrival dependent. We will derive the relationship of phase shifting and element displacement using Error! Reference source not found. This depicts coordinate systems, propagation vector, and geometry for an array antenna (100). The array may not be planner, but the array elements (131, 132, 133, 134) are oriented with boresight (the direction of maximum gain for an antenna) parallel to Z-axis (110) and distributed near the X-Y plane at Z=0. As indicated, K 150 is the wave number vector, indicating that the propagation direction is "θ" angle away from the boresight "Z" axis. The X-axis is (120), while the Y-axis is pointing out from the paper and is not shown.

Perturbations on array element positions may create phase variations on the array elements. However, the phase variations induced by position perturbations are directionally dependent. Let us assume the K is on the XZ plane:

$$\underline{K} = axKx + ayKy + azKz \quad (1)$$

$$== axK\sin\theta + azK\cos\theta \quad (1a)$$

Let us further assume that there are no rotational motions on the positional perturbations. The re-positioning distance for an array element is represented by a vector δd.

$$\delta d = ax\Delta x + ay\Delta y + az\Delta z \quad (2)$$

As a result of the linear translational perturbations, the associated element phase is altered by $$\phi = K\sin\theta\Delta x + K\cos\theta\Delta z \quad (3)$$

Let us make a few observations:

a. When δd=az Δz, or the element perturbations are along the Z-axis for all the elements
   1. the resulting phase variations on the perturbed element become "directionally dependent," $\phi(\theta)==K\cos\theta\,\Delta z$
   2. at the boresite direction where θ=0°, $$\phi(0°) = K^*\Delta z = 2\pi\Delta z/\lambda \quad (3a)$$

3. at horizons where θ=90°, $$\phi(90°) = 0 \quad (3b)$$

b. When δd=ax Δx, or the element perturbations are along the X-axis for all the elements
   1. the resulting phase variations on the perturbed element become "directionally dependent," $\phi(\theta)=K\sin\theta\,\Delta x$
   2. at the boresite direction where θ=0°, $$\phi(0°) = 0 \quad (3c)$$

3. at horizons where θ=90°, $$\phi(90°) = K^*\Delta x = 2\pi^*\Delta x/\lambda \quad (3d)$$

Array antennas in receiving (Rx) modes feature (planar) wavefronts coming from various radiation sources from different directions. The phase sensitivity of positioning perturbations is highly directional-selective. The most sensitive element perturbation direction for a source in the far field is the one perpendicular to the associated wavefronts, and the least sensitive element perturbation direction is the one parallel to the associated wavefronts.

Similarly, positioning perturbations on defocused array feeds of reflector (or lens) antennas will also result on directionally dependent phase shifting on individual elements.

Figure 2:
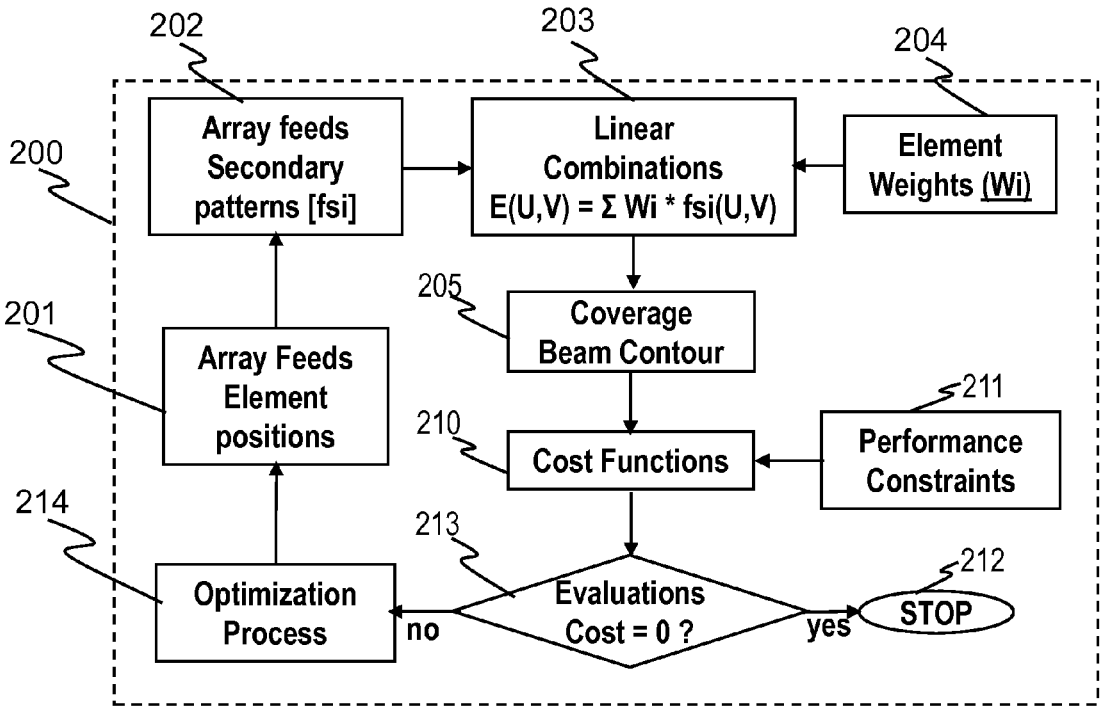
FIG. 2 depicts the functional flow chart of an optimization scheme to obtain desired array geometry based on performance constraints.

In order to calculate optimized array geometries, SDS has developed iterative techniques for the array antennas or antennas with array feeds of meeting prescribed performance constraints. A simplified block diagram for the iterative techniques (200) is depicted in FIG. 2 for array antennas. Similar diagrams for other antenna architectures can be produced by modifying the calculations in far field radiation patterns (202).

Array elements (201) with re-positioning are arranged to produce far field radiations and their individual far field patterns are calculated and tabulated in a file as secondary element patterns (202). As an element is repositioned, its secondary pattern in the far field is modified accordingly. By combining all the elements by a fixed beam forming network (BFN), the predicted far field pattern (204) of a resulting beam is a linear combination (203) of the secondary patterns (202). The element weights (204) are dictated by the structures of the fixed BFN.

Based on the evaluation (213) of the predicted far-field patterns (204) vs. the performance constraints (211) at various far field directions, a set of cost functions (210) are generated. The cost functions must be "positive definite." The cost is the sum of all cost functions. When the cost is high, a feed back loop is activated to "repositioning" the elements (201) iteratively in the directions of minimizing total cost via an optimization processing (214). The iterative process will stop when the total cost equals to zero or below a small threshold.

The methodology of finding the optimal positioning of a specified array antenna is on an optimization processing (214); which may be implemented with various algorithms. We will use a cost minimization algorithm for the illustration.

The antenna configuration including associated feed positions (201) is designed via a configuration iterative synthesis technique. The technique consists of three major program blocks: (1) far-field pattern predictions or calculations (203) for various array configurations including the geometries and element amplitude and phase weightings, (2) diagnostic method (210) of detecting the cost functions and the current "configuration gradients" to get to the desired configurations, and (3) iterative algorithms (214) to get to the desired configuration using information from (2).

Figure 3:
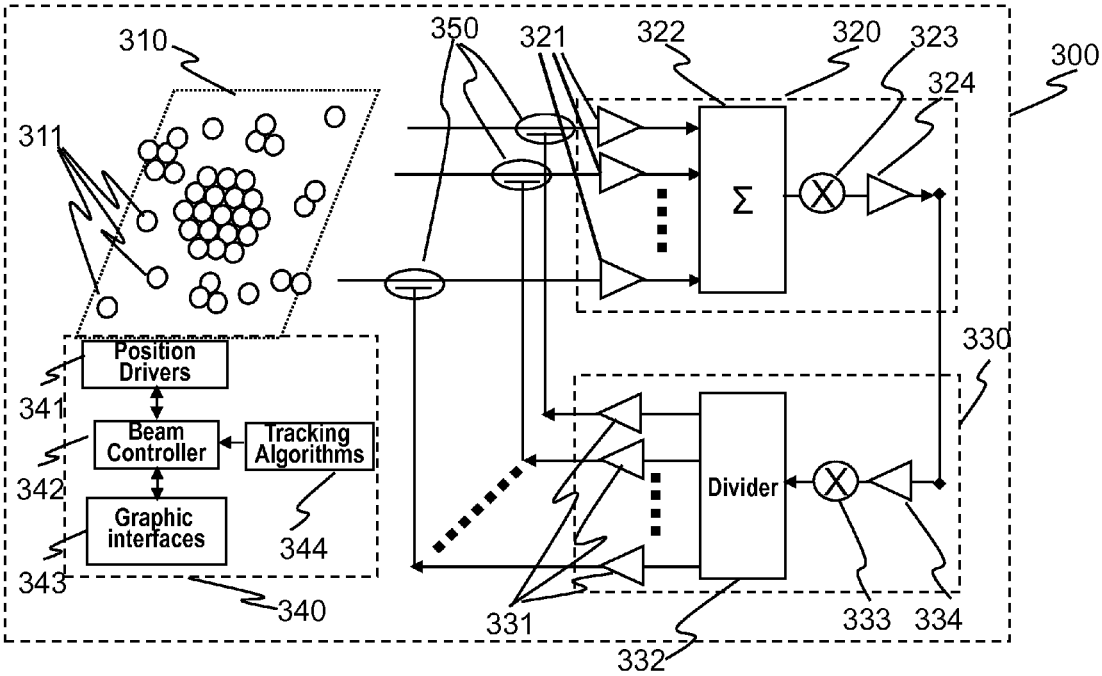
FIG. 3 depicts the functional block diagram of a "bent-pipe" payload with single reconfigurable beam on a satellite with an array antenna via element repositioning for both transmit and receiving functions in accordance with present invention.

FIG. 3 depicts a block diagram of an array antenna (310) on board a satellite for a simple bent pipe payload (300) with a single beam covering a desired service area for both transmit and receive functions. The array antenna (310) consisting of 40 array elements (311) performing both Rx and Tx functions. Each element is connected by a diplexer (350) with two separated arms which are connected by Rx functional blocks (320) and Tx blocks (330) individually. The Rx signals captured by the array elements (311) will flow through the diplexers (350) and amplified by LNAs (321) individually before summed up together by a Rx N-to-1 power combiner (322), where N is the number of Rx signal inputs. The output is down converted to a common IF signals by mixers (323) and amplified and filtered by buffer amplifiers (324) before delivered to the Tx functional block (330).

In the Tx functions, the Rx IF signals are conditioned and frequency up-converted by a set of amplifiers (334) and mixers (333), divided by a 1-to-N power dividing network (332), where N is the number of Rx signal inputs from the previous. Each of the outputs is amplified by HPA (331). The amplified signals will flow through the Tx input of an diplexer (350) and radiated by the associated array element. The radiated powers from various elements are spatially combined in the far field.

Conventional BFNs use passive microwave circuits for input manifolds (1-to-N dividers) or output manifolds (N-to-1 combiners). In addition, there are active electronic, electromagnetic (EM), or mechanical phase shifters and amplitude attenuators (or equivalently I/Q weighting) connected in-line to transmission lines delivering signals to and from elements of array antenna elements. Typically, each element signal is phase-shifted and amplitude attenuated (or weighted) differently to control radiation patterns, shaping the patterns into desired contours.

The current embodiment utilizes beam forming functions for both Rx and TX are achieved by element re-positioning mechanisms (340). The element re-positioning techniques perform beam shaping and phase equalization functions concurrently for all elements in both Rx and Tx frequency bands. The repositioning of one element will impact both Tx and Rx radiation patterns. There are no conventional beam forming networks (BFNs) for both Tx and Rx functions. In Rx, a N-to-1 power combiner (322) serves as a Rx output manifold combining N-Rx elements into one channel. Similarly in Tx, a 1-to-N power divider (332) serves as a Tx input manifold dividing a single channel into N-elements.

Figure 4:
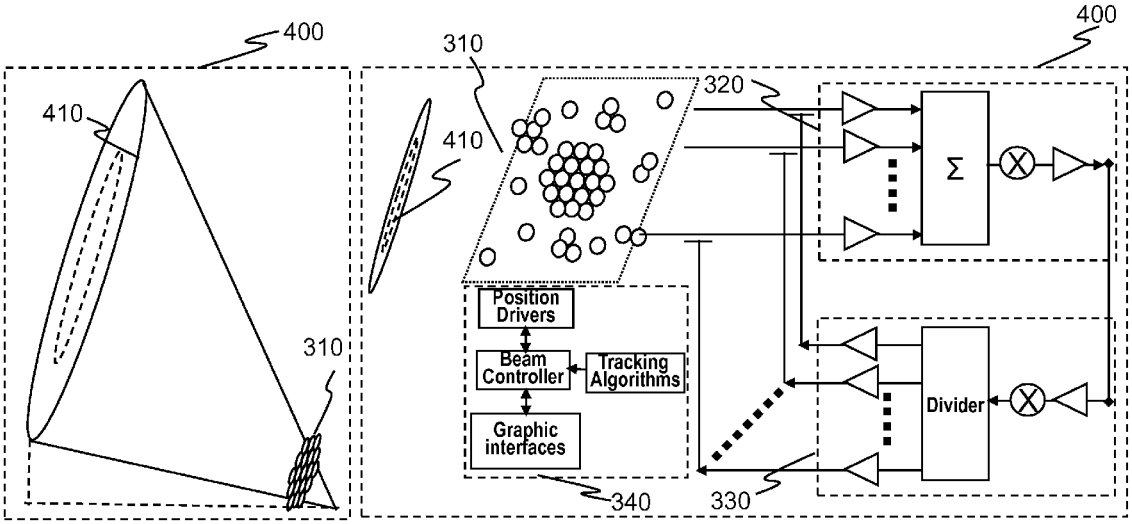
FIG. 4 depicts the functional block diagram of a "bent-pipe" payload with single reconfigurable beam on a satellite with a defocused reflector and array feeds with repositioning capability for both transmit and receiving functions in accordance with present invention.

FIG. 4 depicts a block diagram of a defocused MBA antenna (400) on board a satellite for a simple bent pipe payload with a single beam covering a desired service area for both transmit and receive functions. The array antenna (310) consisting of 40 array elements (311) performs both Rx and Tx functions. Each element is connected by a diplexer (350) with two separated arms which are connected by Rx functional blocks (320) and Tx blocks (330) individually. The Rx signals reflected by the reflector (410) are captured by the array elements (310) which are defocused from the reflector focus, and will then flow through the diplexers (350) and amplified by LNAs (321) individually before summed up together by a Rx N-to-1 power combiner (322). The output is down converted to a common IF by mixers (323) and amplified and filtered by buffer amplifiers (324) before delivered to the Tx functional block (330).

In the Tx functions, the Rx IF signals are conditioned and frequency up-converted by a set of amplifier (334) and mixers (333), divided by a 1-to-N power dividing network (332). Each of the outputs is amplified by HPA (331). The amplified signals will flow through the Tx input of an diplexer (350) and radiated by the associated array element. The radiated powers from various elements are reflected by the reflector (410) and they are spatially combined in the far field.

Conventional BFNs use passive microwave circuits for input manifolds (1-to-N dividers) or output manifolds (N-to-1 combiners). In addition, there are active electronic, electromagnetic (EM), or mechanical phase shifters and amplitude attenuators (or equivalently I/Q weighting) connected in-line to transmission lines delivering signals to and from elements of array antenna elements. Typically, each element signal is phase-shifted and amplitude attenuated (or weighted) differently to control radiation patterns, shaping the patterns into desired contours.

In our invention, the beam forming functions for both Rx and TX are achieved by element re-positioning mechanisms (340). The element re-positioning techniques do beam shaping and phase equalizations concurrently for all elements in both Rx and Tx frequency bands. The repositioning of one element will impact both Tx and Rx radiation patterns. There are no conventional BFNs for both Tx and Rx functions. In Rx, a N-to-1 power combiner (322) serves as a Rx output manifold combining N-Rx elements into one channel. Similarly in Tx, a 1-to-N power divider (332) serves as a Tx input manifold dividing a single channel into N-elements.

For geostationary earth orbits (GEO), the satellite position will stay fixed in the sky, requiring only an initial setup of the antenna array positioning. On the other hand, it is possible to place a satellite in inclined GEO orbits with small inclined angles in which the satellite ground coverage will vary over a 24 hour period. The positions of array elements can then be dynamically adjusted according to time of the day covering the same areas on earth, when the satellite's position changes in the orbits.

Figure 5:
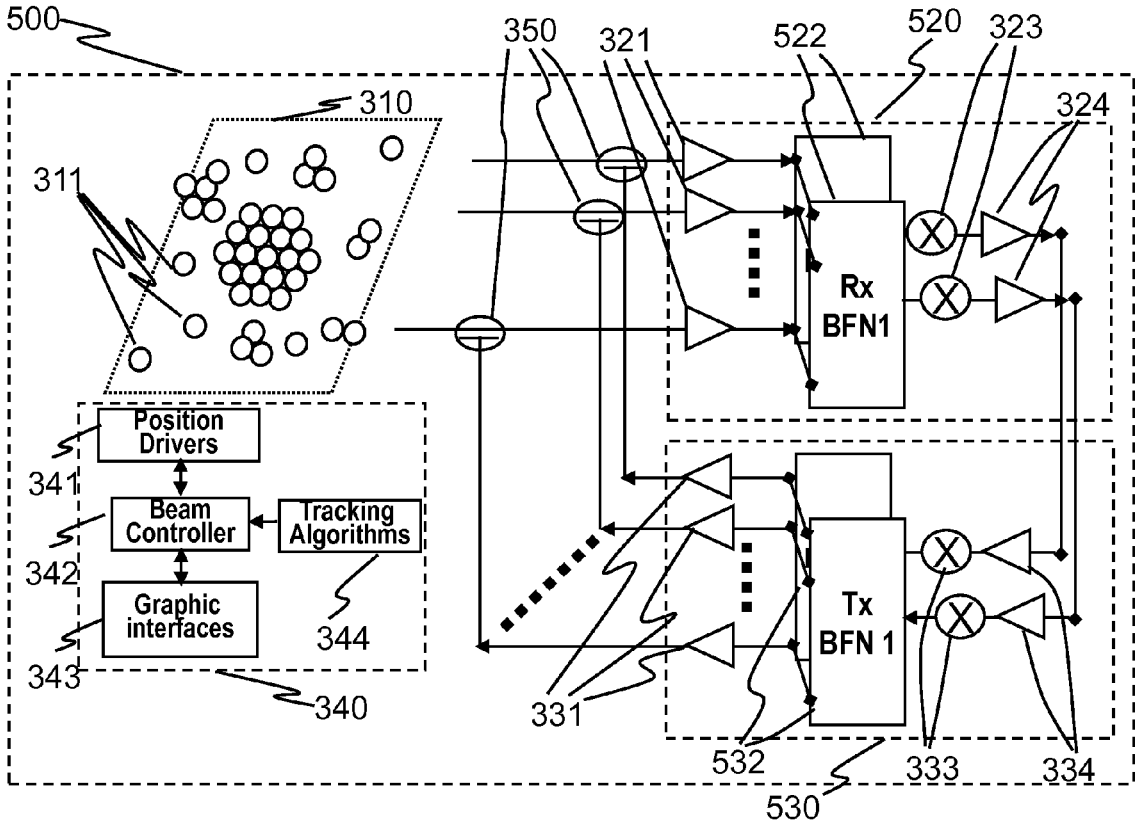
FIG. 5 depicts the functional block diagram of a "bent-pipe" payload with multiple reconfigurable beams on a satellite with an array antenna via element repositioning for both transmit and receiving functions in accordance with present invention.

FIG. 5 depicts a block diagram of an array antenna (310) on board a satellite for a simple bent pipe payload (500) with two beams covering two desired service areas for both transmit and receive functions. The two beams may be contour-shaped beams or spot beams. If the two coverage areas are disjointed, the two beams may operate in the same spectrum. This is an extension to FIG. 3. The only differences are 1. the Rx functional block (320) in FIG. 3 is replaced by a Rx functional block (520) in FIG. 5
   the power combining circuit (322) in the Rx functional block (320) is replaced by two Rx BFNs (522) in parallel in the Rx functional block (520).
2. the Tx functional block (330) in FIG. 3 is replaced by a Tx functional block (530) in FIG. 5
   the power dividing circuit (332) in the Tx functional block (330) is replaced by two Tx BFNs (532) in parallel in the Tx functional block (530).
3. The connections between Rx and Tx blocks increased from 1 in FIG. 3 to 2 in FIG. 5.

The concept can be extended to more than two beams using the same array antennas. One such an example is an array antenna forming four contiguous beams covering 4 separated time zones over the continental United States (CONUS).

The array antenna (310) consisting of 40 array elements (311) performs both Rx and Tx functions. Each element is connected by a diplexer (350) with two separated arms which are connected by Rx functional blocks (520) and Tx blocks (530) individually. The Rx signals captured by the array elements (311) will flow through the diplexers (350) and amplified by LNAs (321) individually before two BFNs (522), which provide two different sets of weighting to various Rx signals and summations to form to separate beams. The two beam outputs are down converted to a common IF by two mixers (323) and amplified and filtered by two buffer amplifiers (324) before delivered to the Tx functional block (530).

In the Tx functions, the IF signals from the two Rx beams are conditioned and frequency up-converted by two sets of amplifiers (334) and mixers (333). Conditioned signals are connected to two parallel Tx BFNs (532), each divided into N separated channels. The two sets of N element channels are combined, element by element, into one set of N-element channels. Each element channel is amplified by HPA (331). The amplified signals will flow through the Tx input of an diplexer (350) and radiated by the associated array element. The radiated powers from various elements are spatially combined in the far field.

Conventional BFNs use passive microwave circuits for input manifolds (1 to N dividers) or output manifolds (N-to-1 combiners). In addition, there are active electronic, electromagnetic (EM), or mechanical phase shifters and amplitude attenuators (or equivalently I/Q weighting) connected in-line to transmission lines delivering signals to and from elements of array antenna elements. Typically, each element signal is phase-shifted and amplitude attenuated (or weighted) differently to control radiation patterns, shaping the patterns into desired contours.

There are two Rx fixed BFNs (522) and two Tx BFNs (532). An N-to-1 power combiner (322) serves as an Rx output manifold in a Rx BFN (522), and a 1-to-N power divider (332) as a Tx input manifold in a Tx BFN (532). Each fixed BFN can be designed to cover a prescribed region on earth for an array. Additional flexibility of beam forming functions for both Rx and TX is achieved by element re-positioning mechanisms (340). The element re-positioning techniques do beam shaping and phase equalizations concurrently for all elements in both Rx and Tx frequency bands.

It is optional that one of the two Rx fixed BFNs (522) will be a N-to-1 power combiner (322), and one of the two Tx fixed BFNs (532) will be a 1-to-N power divider (332).

Figure 6:
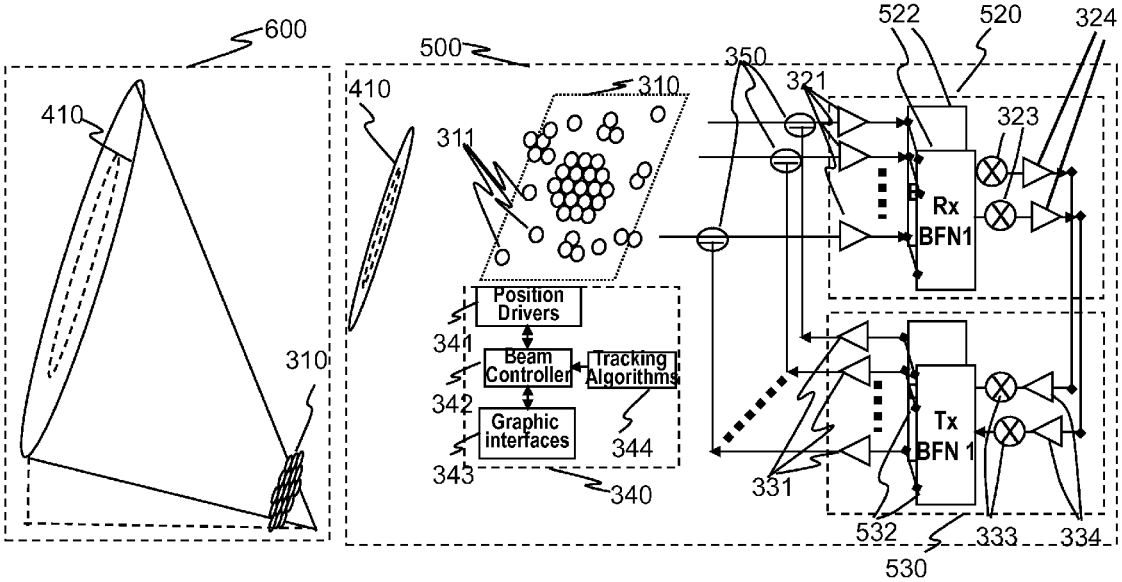
FIG. 6 depicts the functional block diagram of a "bent-pipe" payload with multiple reconfigurable beams on a satellite with a defocused reflector and array feeds with repositioning capability for both transmit and receiving functions in accordance with present invention.

FIG. 6 depicts a block diagram of a reflector antenna (410) with defocused array feeds (310) on board a satellite for a simple bent pipe payload (600) with two beams covering two desired service areas for both transmit and receive functions. The two beams may be contour-shaped beams or spot beams. If the two coverage areas are disjointed, the two beams may operate in the same spectrum. This is an extension to FIG. 4. The only differences are 1. the Rx functional block (320) in FIG. 4 is replaced by a Rx functional block (520) in FIG. 6
   the power combining circuit (322) in the Rx functional block (320) is replaced by two Rx BFNs (522) in parallel in the Rx functional block (520).
2. the Tx functional block (330) in FIG. 4 is replaced by a Tx functional block (530) in FIG. 6
   the power dividing circuit (332) in the Tx functional block (330) is replaced by two Tx BFNs (532) in parallel in the Tx functional block (530).
3. The connections between Rx and Tx blocks increased from 1 in FIG. 4 to 2 in FIG. 6.

The concept can be extended to more than two beams using the same reflector antenna with defocused array feeds. One such an example is an antenna forming four contiguous beams covering 4 separated time zones over CONUS.

The defocused array feeds (310) consisting of 40 array elements (311) performs both Rx and Tx functions. Each element is connected by a diplexer (350) with two separated arms which are connected by Rx functional blocks (520) and Tx blocks (530) individually. The Rx signals captured by the array elements (311) will flow through the diplexers (350) and amplified by LNAs (321) individually before two BFNs (522), which provide two different sets of weighting to various Rx signals and summations to form to separate beams. The two beam outputs are down converted to a common IF by two mixers (323) and amplified and filtered by two buffer amplifiers (324) before delivered to the Tx functional block (530).

In the Tx functions, the IF signals from the two Rx beams are conditioned and frequency up-converted by two sets of amplifier (334) and mixers (333). Conditioned signals are connected to two parallel Tx BFNs (532), each divided into N separated channels. The two sets of N element channels are combined, element by element, into one set of N-element channels. Each element channel is amplified by HPA (331). The amplified signals will flow through the Tx input of an diplexer (350) and radiated by the associated array element. The radiated powers from various elements are spatially combined in the far field.

Conventional BFNs use passive microwave circuits for input manifolds (1-to-N power dividers) or output manifolds (N-to-1 power combiners). In addition, there are active electronic, electromagnetic (EM), or mechanical phase shifters and amplitude attenuators (or equivalently I/Q weighting) connected in-line to transmission lines delivering signals to and from elements of array antenna elements. Typically, each element signal is phase-shifted and amplitude attenuated (or weighted) differently to control radiation patterns, shaping the patterns into desired contours.

There are two Rx fixed BFNs (522) and two Tx BFNs (532). An N-to-1 power combiner (322) serves as an Rx output manifold in an Rx BFN (522), and a 1-to-N power divider (332) as a Tx input manifold in a Tx BFN (532). Each fixed BFN can be designed to cover a prescribed region on earth for an array. Additional flexibility of beam forming functions for both Rx and TX is achieved by element re-positioning mechanisms (340). The element re-positioning techniques do beam shaping and phase equalizations concurrently for all elements in both Rx and Tx frequency bands.

It is optional that one of the two Rx fixed BFNs (522) will be an N-to-1 power combiner (322), and one of the two Tx fixed BFNs (532) will be a 1-to-N power divider (332).

Figure 7:
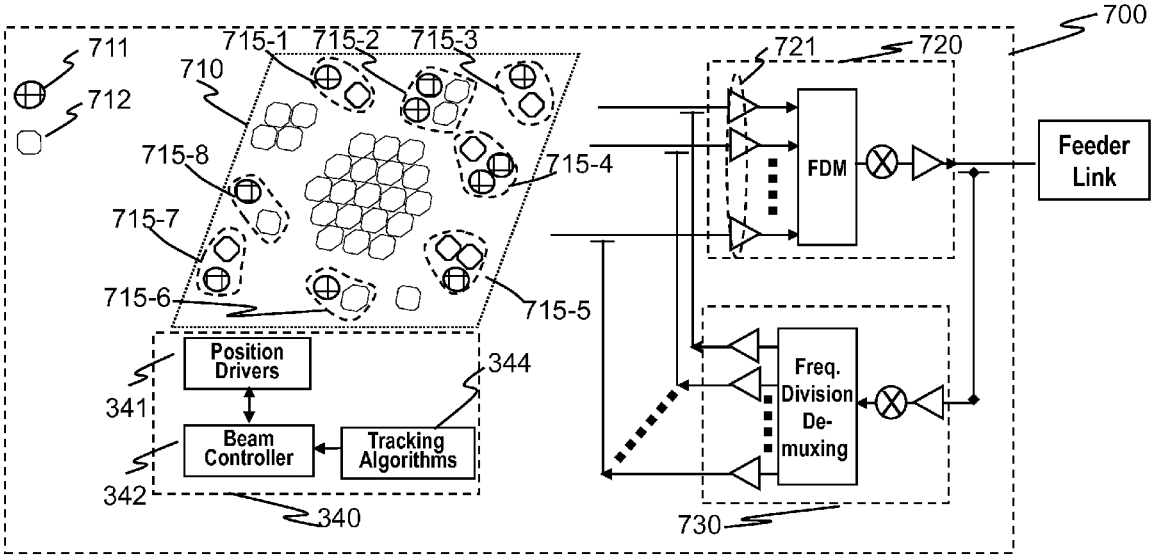
FIG. 7 illustrates a functional block diagram of a payload with multiple reconfigurable beams on a satellite with an array antenna with total N array elements for both transmit and receiving functions via (a) remote beam forming for M elements and (b) additional N-M elements by repositioning; N>M in accordance with present invention. In this example N=43 and M=33.

FIG. 7 illustrates a functional block diagram of a satellite payload using ground based beam forming (GBBF) for multiple reconfigurable beams. The on-board antenna features a direct radiating array with total N array elements for both transmit and receiving functions via a feeder link connecting to a GBBF facility on ground or a remote beam forming (RBF) on a mobile platform. The feeder link featuring M independent channels can only handle signals for M elements, where N>M. The example illustrates how to use the repositioning of additional N-M elements as a part of the reconfigurable capability.

The same concept can be extended to other antenna configurations; in which the numbers of feeder-link I/O channels (M) are less than the numbers of array elements (N). The on-board antennas may be magnified phased array antennas, or multi-beam antennas (MBAs) with defocused feed arrays; such as the ones shown in FIG. 4 and FIG. 6.

In this embodiment N=43 and M=33, the array antenna (710) features 43 array elements randomly distributed. The elements for both transmit (Tx) and receive (Rx) functions are in two groups; (a) fixed elements (711) and (b) movable elements (712). 10 of the 43 elements can be re-positioned mechanically. The repositioning motions include element translations, and/or rotations. Each element is connected by a diplexer separating the Rx and Tx frequency bands. The movable elements are driven by the position drivers (341), controlled by the beam controller (342). The controller has access to radiation pattern optimization/tracking processor (344).

There are 8 subarrays (715-1, 715-2, 715-3, 715-4, 715-5, 715-6, 715-7, 715-8) combined individually by 8 on-board BFNs; some with two elements, others with 3 to 4 elements. They are categorized into 4 groups. 5 subarrays (715-1, 715-3, 715-6, 715-7, 715-8) are in group 1 featuring one fixed and one movable elements. The BFNs for a subarray in group 1 is 90°-hybrids. There is only one input channel from the feeder link, and one output channel to the feeder-link.

There is only 1 subarray (715-4) in group 2 featuring two fixed and one movable element. The BFNs for the subarray is a 2-to-3 hybrid network with two input channels from the feeder link, and two output channels to the feeder-link.

There is 1 subarray (715-5) in group 3 featuring one fixed and two movable elements. The BFNs for the subarray is a 1-to-3 hybrid network with one input channel from the feeder link, and one output channel to the feeder-link.

There is 1 subarray (715-2) in group 4 featuring two fixed and two movable elements. The BFNs for the subarray is a 2-to-4 hybrid network with two input channels from the feeder link, and two output channels to the feeder-link.

As a result, there are only 33 two-way I/O channels between array antennas and the feeder-links to control 43 elements in the array antennas.

For return link processing, user signals collected by the array elements or subarray beams, are processed by an onboard Rx processor (720) in which the 33 signals are individually amplified by 33 LNAs, and then combined by a frequency division multiplexer (FDM) before frequency up-converted and then power amplified for feeder-link transmission (750) to a GBBF processing site on ground. The feeder links feature broadband multi-channel transmission between a satellite and a ground processing facility, and may be in X, Ku, or Ka band.

For forward link processing, signals collected by the feeder link (750) from the GBBF processing facility on the ground are processed by an onboard Tx processor (730) in which the receive signals are conditioned and down converted before frequency de-multiplexed into 33 signals channels. After down conversions the signals are individually conditioned, and power amplified. The amplified signals are then sent through the diplexers to the individual elements or subarrays.

There are 33 fixed elements for R-DBF via feeder-links and additional 10 elements for beam shaping via re-positioning individual elements. By changing the array geometry, both Rx and Tx patterns of the array will be altered. On the other hand, the array element positions are optimized to achieve a prescribed shaped beam. For geostationary earth orbits (GEO), the satellite position will stay fixed in the sky, requiring only an initial setup of the antenna array positioning. On the other hand, it is possible to place a satellite in inclined GEO orbits with small inclined angles in which the satellite ground coverage will vary over a 24 hour period. The rate of field of view (FOV) changes may be in the order of once per half an hour. On the other hand beam position changes within a FOV may be in a frame rate of once per 10 mille-second.

The satellite antenna design with more flexibility with the same bandwidth on the feeder-links takes advantage of the slow variation features of inclined orbits. The design features additional 10 array feeds controllable via feed re-positioning. The additional feeds may be sparsely placed on the spacecraft, and may not be on a plane. The new design would have 43 elements total. However, they are combined on board into 33 independent subarray beams/elements. The individual subarray radiation patterns are alterable via element positioning in the subarray. As a result, 1-GHz back channels in the feeder-links are supporting 33 subarrays/elements, each with 30 MHz bandwidth on a satellite. The total number of controllable element on the new satellite would be 43. The positions of 10 array elements can then be adjusted once every half an hour accordingly to the time of the day covering the same areas on earth, but with different FOV from the moving satellite in an inclined orbit.

We shall focus this disclosure on the GEO case. Those familiar with satellite communications can convert the configurations of GEO applications to those for the non-GEO applications.

Figure 8:
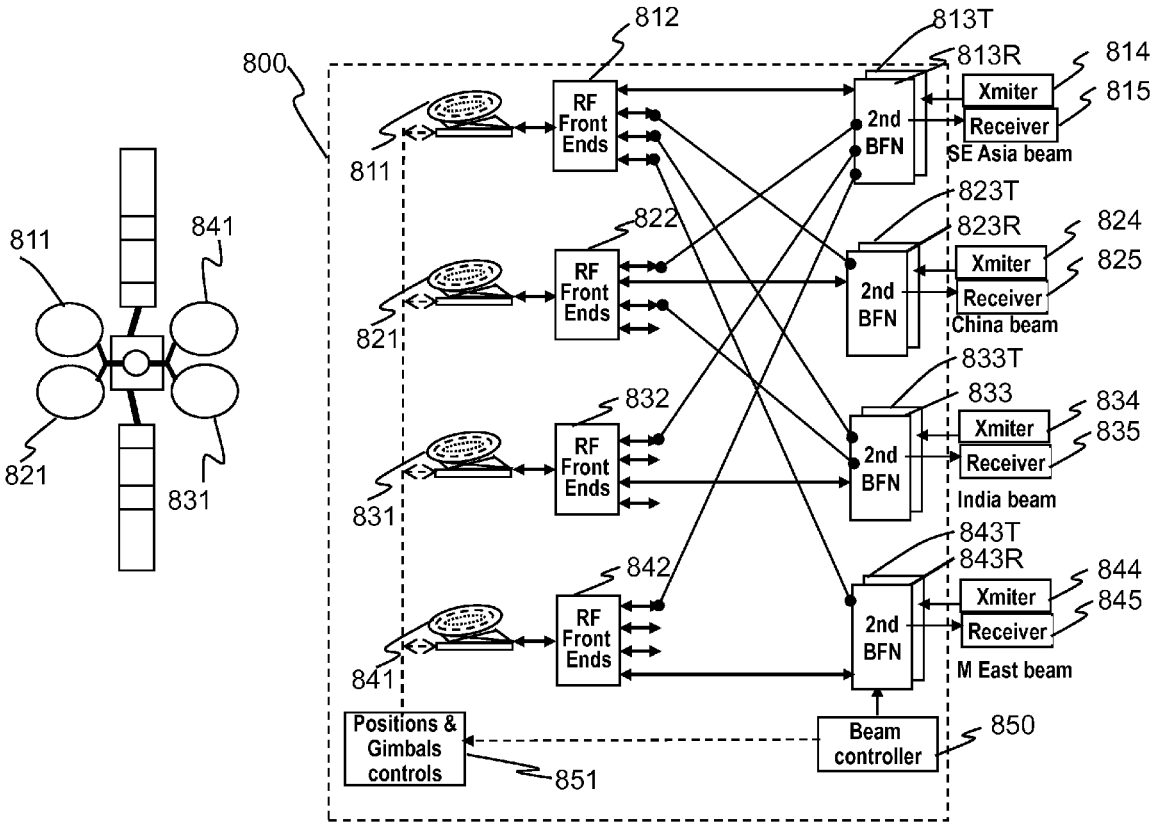
FIG. 8 is a block diagram of an example of satellite antennas with concurrent multi-beam coverage via multiple shaped reflectors, beam forming networks (BFNs) and repositioning of the shaped reflectors in accordance with present invention. Each reflector is illuminated by array feeds connected by a block of RF front end including both Rx and Tx functions. There are four Rx contour beams and four Tx contour beams. Each is generated by the combinations of all four reflectors.

FIG. 8 is a block diagram of an example of a satellite antenna farm (800) with concurrent multiple-beam coverage via four shaped reflectors (811, 821, 831, 841), 4 BFNs (813, 823, 833, 843), and repositioning mechanisms and controls (851) of the 4 shaped reflectors. In this embodiment there are four beams; one each covering SE Asia, China, India and Middle East. Each reflector is illuminated by array feeds connected by a block of RF front ends (812, 822, 832, 842) including both Rx and Tx functions. There are four Rx contour beams and four Tx contour beams. Each is generated by the combinations of all four reflectors (811, 821, 831, 841). Beam shaping via multiple reflectors will provide shaper falloff at the beam edges, and better in-beam resolutions.

Signals received by the S.E. Asia Rx beam come out from the BFN (813R) which is connected to a receiver (815). Transmitted signals for the S. E. Asia beam after conditioned and power amplified by the transmitter (814) are injected into the Tx BFN (813T) which are connected to four separated RF front ends (812, 822, 832, 842) of associated reflectors (811, 821, 831, 841).

Signals received by the Rx China beam come out from the BFN (823R) which is connected to a receiver (825). Transmitted signals for China beam after conditioned and power amplified by the transmitter (824) are injected into the Tx BFN (823T) which are connected to four separated RF front ends (812, 822, 832, 842) of the four reflectors (811, 821, 831, 841).

Signals received by the Rx India beam come out from the BFN (833R) which is connected to a receiver (835). Transmitted signals for India beam after conditioned and power amplified by the transmitter (834) are injected into the Tx BFN (833T) which are connected to four separated RF front ends (812, 822, 832, 842) of the same four reflectors (811, 821, 831, 841).

Signals received by the Rx Middle-East (ME) beam come out from the BFN (843R) which is connected to a receiver (845). Transmitted signals for ME beam after conditioned and power amplified by the transmitter (844) are injected into the Tx BFN (843T) which are connected to four separated RF front ends (812, 822, 832, 842) of the same four reflectors (811, 821, 831, 841).

Beam controller (850) and the positioning and gimbals controls (851) provide in orbit beam shaping and reconfigurable capability.

The repositioning processing is mainly for co-polarization interference controls and cross-polarization enhancement. Optional auxiliary elements may be added to various BFN's providing additional degrees of freedoms of controlling interference from adjacent beams. Auxiliary elements may be direct radiating elements covering entire earth, or subarrays covering areas of interest, or highly defocused feeds of various reflectors.

Figure 9:
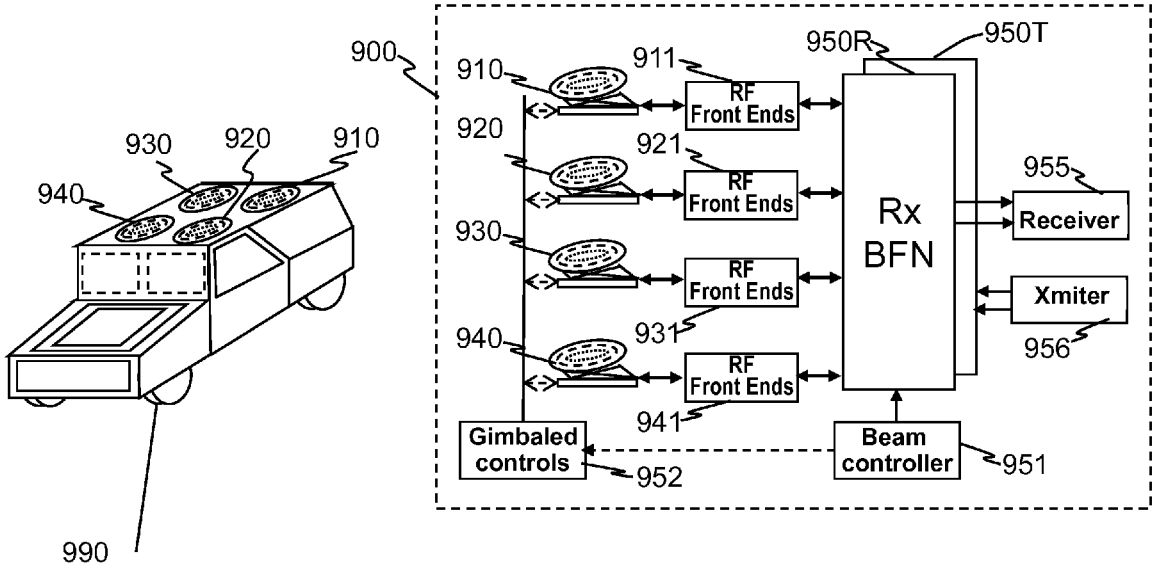
FIG. 9 depicts a functional block diagram of a mobile VSAT terminal with multiple (M) beams pointing to satellites with an array antenna with total N array elements for Tx and/or Rx functions; via (a) gimbaled small array elements for selection of instantaneous field of view, (b) beam forming networks forming multiple dynamic tracking beams with proper nulls, and (c) elements with limited repositioning capability for additional degrees of freedom in beam forming and null steering in accordance with present invention. M=2 and N=4 in this example.

FIG. 9 depicts a functional block diagram of a mobile VSAT terminal (900) with multiple (M) beams pointing to multiple satellites on a moving platform (990). The terminals feature sparse array with total N elements to form M beams. These elements may be small dishes, flat panels, or subarrays. They may not be identical, but will be mounted individually and mechanically gimbaled independently to adjust the element field-of-views (FOVs) aligned to the desired satellites. The array elements are then combined coherently by digital beam forming (DBF) to form beam at a desired direction and steering nulls to prescribed directions of nearby satellites. The moving platforms may be ground based or airborne. M=2 and N=4 in this example The array elements (910, 920, 930, 940) are gimbaled small reflectors (952) for selection of instantaneous field of view. BFN (950-R) dynamically form multiple dynamic tracking Rx beams with proper nulls for Rx functions. BFN (950-T) dynamically form multiple dynamic beams with proper nulls for Tx functions. Array elements (910, 920, 930, 940) with limited repositioning capability (952) provide additional degrees of freedom in beam forming and null steering.

The Rx functions consist of 4 gimbaled reflectors (910, 920, 930, 940), 4 RF front ends (911, 921, 931, 941), and two BFNs (950). The outputs of the Rx BFN (950-R) are connected to two receivers (955). The BFN (950-R) provides 2 dynamic orthogonal beams; each featuring a beam peak pointed to a desired satellite and nulls at other nearby satellites as the platform (990) moves.

Two independent Tx signals from a transmitter (956) are injected into the Tx BFN (950-T), which divides and "weights" each of the Tx signals into 4 separated paths. The weighted 4 signals are connected to 4 RF front ends (911, 921, 931, 941), which provide proper amplifications and filtering before radiated by the four gimbaled dishes (910, 920, 930, 940).

Beam controller (951) and gimbaled control (952) control the weights of BFNs and the displacements of the gimbaled dishes. The gimbaled elements provide the alignments of polarizations and the instantaneous field of views.

Figure 10:
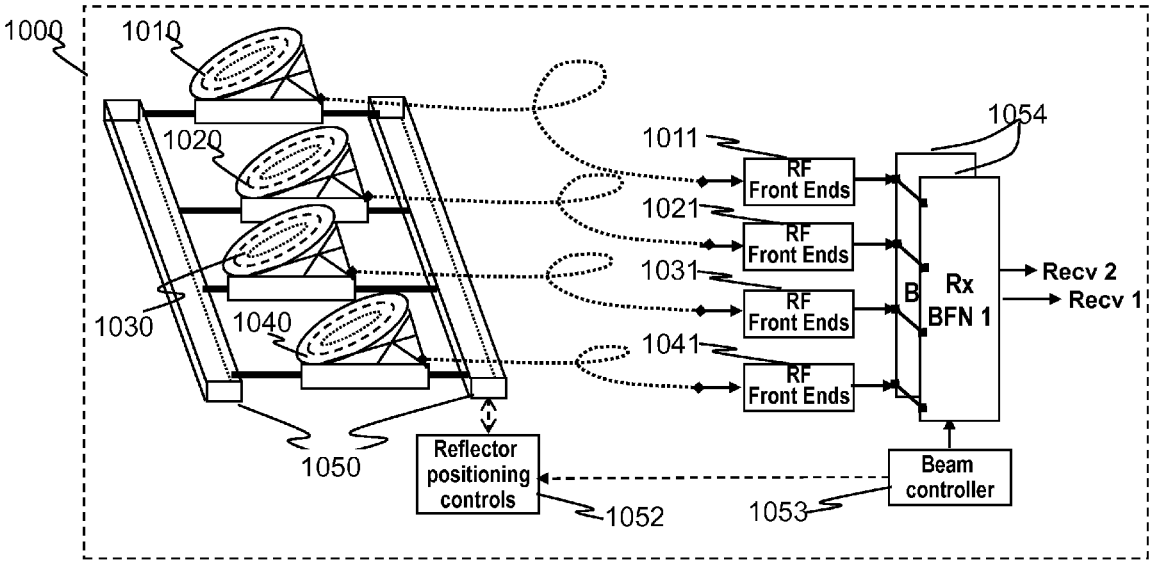
FIG. 10 depicts a functional block diagram of a fixed DTH (Direct-to-Home) terminal with multiple (M) beams pointing to adjacent satellites utilizing an array of antennas with total N array elements for receiving functions; via (a) gimbaled element apertures for selection of instantaneous field of view, (b) beam forming networks combining signals from multiple apertures, and (c) Reflector elements with repositioning capability by positioning mechanisms for beam forming and null steering in accordance with present invention. M=2 and N=4 in this example.

FIG. 10 depicts a functional block diagram of a fixed DTH (direct-to-home) terminal (1000) with multiple (M) beams pointing to adjacent satellites utilizing an array of antennas (1010, 1020, 1030, 1040) with total N array elements for receiving functions; via (a) gimbaled element apertures for selection of instantaneous field of view, (b) beam forming networks (1054) combining signals from multiple apertures (1010, 1020, 1030, 1040), and (c) Reflector elements (1010, 1020, 1030, 1040) with repositioning capability by positioning mechanisms (1050) for beam forming and null steering. M=2 and N=4 in this example.

The received signals by N individual reflectors (1010, 1020, 1030, 1040) are amplified and filtered by the RF front-ends (1011, 1021, 1031, 1041). The conditioned signals are sent to M BFNs (1054) in Rx combining N inputs to M independent outputs. The M outputs from the BFNs are connected independently to M separated receivers (1055).

With the combinations of the BFNs (1054) and reflector element repositioning by the position control (1050), M independent beams may be formed; each pointing its beam peak to a designated satellite and its nulls toward other undesired satellites.

Figure 11:
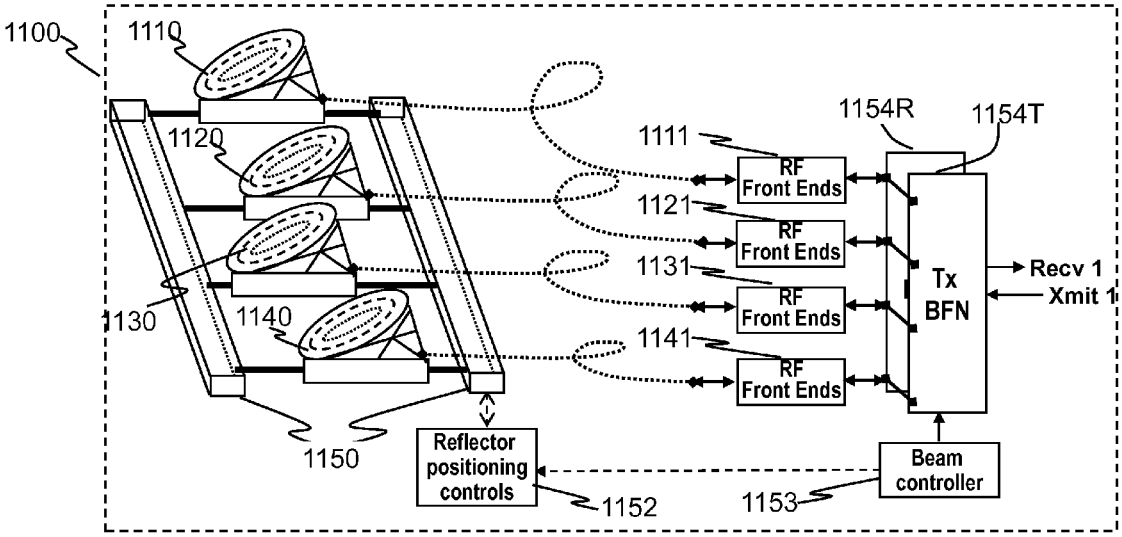
FIG. 11 depicts a functional block diagram of a fixed satellite ground terminal with a single beam pointing to a desired satellite while steering nulls toward nearby undesired satellites utilizing an array of antenna with total N array elements for both transmit and/or receiving functions; via (a) gimbaled element apertures for selection of instantaneous field of view and/or polarization alignment, (b) fixed beam forming networks to combine multiple elements for Tx and Rx functions, and (c) elements with repositioning capability for beam forming and null steering in accordance with present invention. N=4 in this example.

FIG. 11 depicts a functional block diagram of a fixed VSAT ground terminal (1100) with a single beam pointing to a desired satellite while steering nulls toward nearby undesired satellites utilizing an array of 4 reflector elements (1110, 1120, 1130, 1140) for both transmit and receiving functions.

The long baseline architecture is utilized to provide enhanced angular resolution to separate signals from GEO satellites with spacing less than 2°. Baseline is the separation between two elements, and will be oriented in parallel to the local GEO arc. When the baseline between the two outmost reflectors (1110, 1140) approaches 100 wavelengths, the angular resolution will be able to separate signals from two adjacent Geo satellites with only 0.5° spacing.

The VSAT antenna (1100) consists of three major functions; (a) gimbaled reflector apertures (1110, 1120, 1130, 1140) for selection of instantaneous field of view and/or polarization alignment, (b) 2 fixed BFNs (1154R, 1154T) to combine multiple elements into one signal channel for Rx functions and to dividing one signal channel into multiple elements in Tx functions, and (c) elements with repositioning capability (1150, 1152) for beam forming and null steering. Furthermore, the Rx BFN (1154R) can be simplified as a N-to-1 output manifold, and the Tx BFN (1154T) as a 1-to-N input manifold, N=4 in this example. The repositioning mechanisms (1150) and positioning controller (1152) are the processing to provide beam forming, null steering, and multi-element path equalization capability for the VSAT terminal (1100).

It is possible to use the multi-aperture terminals to provide adequate isolations among the two satellites using spatial isolation, enabling both to fully utilize the same spectrum simultaneously and independently. Terminal antennas with multiple apertures can be oriented so that the GEO satellites are separated in the azimuth direction of the array terminals.

Figure 12:
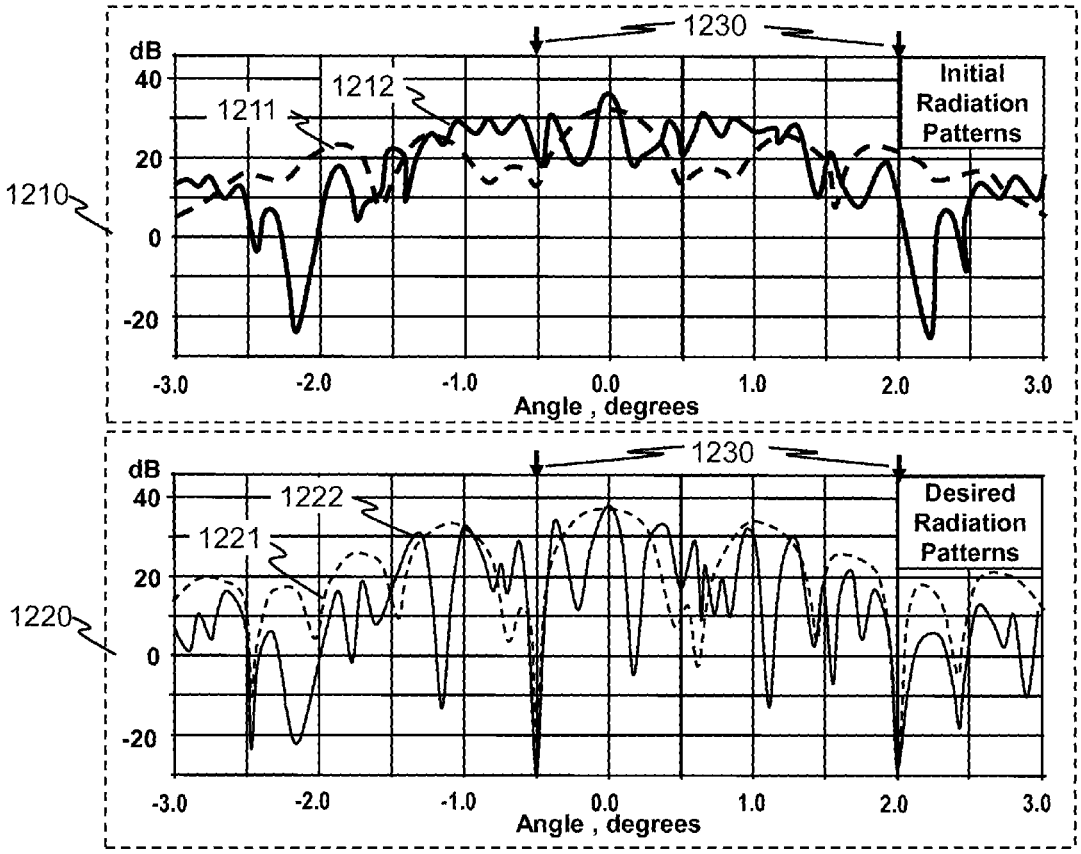
FIG. 12 depicts simulated results of an antenna in FIG. 11; the top panel showing the (initial) radiation patterns before repositioning for both Tx and Rx functions for the reflector array, and the bottom depicting the (desired) radiation patterns after optimizing element positions in accordance with present invention.

FIG. 12 depicts simulated results of one dimensional antenna patterns of such a Ku band VSAT terminal (1100) in FIG. 11. The Ku band uplink is at 14 GHz, and down link at 12 GHz. The optimization is through repositioning of the array elements. In the simulation, we use linear translations only and no rotations on 4 reflector elements featuring 18" in diameters. A linear translation of one reflector will affect both Tx and Rx radiation patterns of the VSAT array. The desired satellite is at 0° and the interfering satellites at −0.5° and 2° in azimuth as depicted by the arrows (1230) on both panels. They all operate at the same frequency band.

The top panel (1210) shows an (initial) Rx radiation pattern (1211) at 12 GHz for the reflector array (1110, 1120, 1130, 1140) and a Tx radiation pattern (1212) at 14 GHz before repositioning, and the bottom panel (1220) depicting the (desired) Rx radiation pattern (1221) and the Tx radiation pattern (1222) after optimizing element positions. The vertical axes for both panels depict the relative intensity in a dB scale, and the horizontal axes show the azimuth angles in degrees from a ground station viewing the Geo-stationary arc in sky.

It is clear that the spacing-optimized array antenna features beam peaks at the desired satellite direction for both the Rx and the Tx beams, while they exhibit simultaneously deep directional nulls at the undesired satellite directions (1230) for both Rx and Tx beams (1221, 1222).

Operators for both satellites (at 0°) and 0.5°) would benefit from the proposed ground terminals (1100) with the capability of forming a beam peak to the desired satellite direction and simultaneously moving a null to the direction of other interfering satellites near by. This spatial isolation capability enables both system operators to use the same spectrum, operating both satellite systems independently and concurrently and with 100% revenue generation capability.

The radiation patterns of multi-aperture terminals can be controlled by electronic amplitude attenuators and phase shifters or I/Q weighting circuits. They are available to the operator but are more costly. Using antenna element positioning to form directional beams and nulls would be an alternative to achieve the same goal with reduced costs for ground terminals.

Figure 13:
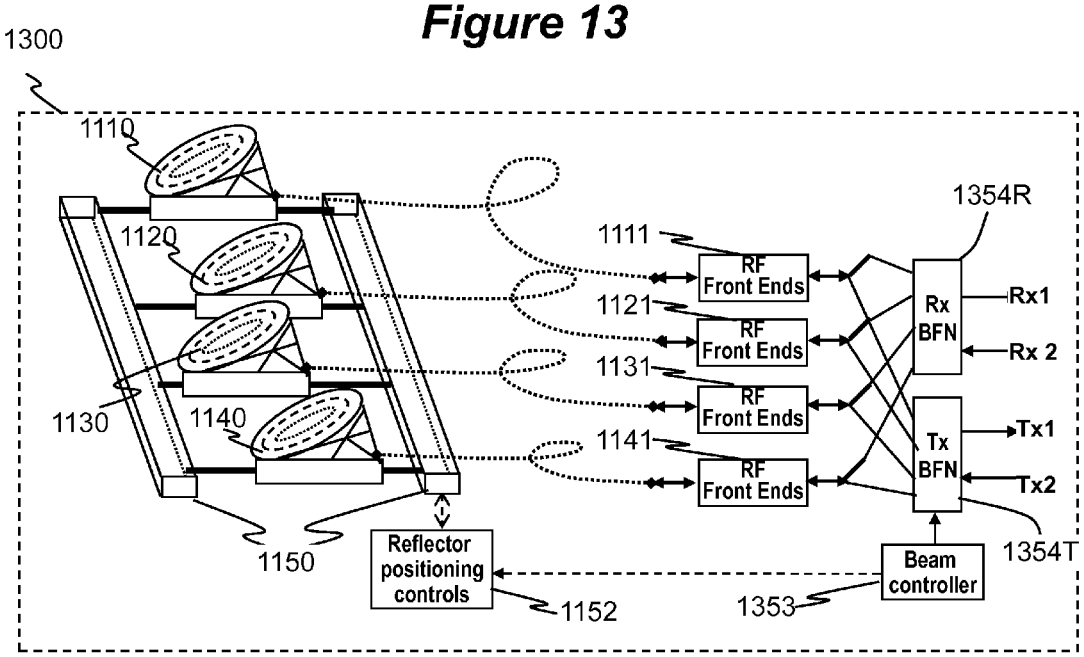
FIG. 13 depicts a functional block diagram of a fixed satellite ground terminal with multiple beams pointing to desired satellites individually while steering nulls toward nearby undesired satellites utilizing an array of antenna with total N array elements for both transmit and/or receiving functions; via (a) gimbaled element apertures for selection of instantaneous field of view and/or polarization alignment, (b) beam forming networks to combine multiple elements for Tx and Rx functions, and (c) elements with repositioning capability for beam forming and null steering in accordance with present invention. N=4 in this example.

FIG. 13 depicts a functional block diagram of a fixed VSAT ground terminal (1300) with two orthogonal beams; each pointing to a desired satellite while steering nulls toward nearby undesired satellites utilizing an array of 4 reflector elements (1110, 1120, 1130, 1140) for both transmit and receiving functions. It is an extension of the single beam VSAT configuration in FIG. 11. The BFNs (1154) in FIG. 11 is replaced by a pair of BFNs (1354-1, 1354-2) in FIG. 13;

The long baseline architecture is utilized to provide enhanced angular resolution to separate signals from GEO satellites with spacing less than 2°. Baseline is the separation between two elements, and will be oriented in parallel to the local GEO arc. When the baseline between the two outmost reflectors (1110, 1140) approaches 100 wavelengths, the angular resolution will be able to separate signals from two adjacent Geo satellites with only 0.5° spacing.

The VSAT antenna (1300) consists of the following major functions; (a) gimbaled reflector apertures (1110, 1120, 1130, 1140) for selection of instantaneous field of view and/or polarization alignment, (b) a set of fixed Rx BFNs (1354-R) forming two Rx beams pointing to two satellites accordingly, (c) another set of fixed Tx BFNs (1354-T) forming two Tx beams pointing to two satellites individually, and (d) element repositioning mechanisms (1150) and associated controller (1152) for null steering.

The Rx BFN (1354-R) is a BFN for orthogonal beams such as Butler Matrix. A 4-to-4 1-D Butler Matrix features the capability of generating 4 simultaneous Rx Beams. We may choose 2 of the 4 Rx beams for this example. The 4 input ports are connected to the RF front-ends (1111, 1121, 1131, 1141) with 2 of 4 outputs connected to two separated receivers one for satellite 1 and the other for the second satellite. The remaining two output ports will be loaded by 50 ohm loads.

Similarly, the Tx BFN (1354-T) is also a BFN for orthogonal. We may choose another 4-to-4 1-D Butler Matrix for Tx. The 4 output ports are connected to the RF front-ends (1111, 1121, 1131, 1141) with 2 of 4 inputs connected to two separated transmitters one for satellite 1 and the other for the second satellite. The remaining two input ports will be loaded by 50 ohm loads.

What is claimed is:

1. An antenna system comprising:

multiple antenna feed elements;

and multiple beam forming networks with multiple element weightings associated with the multiple feed elements configured to produce radiation patterns for both receiving and transmission functions configured to be optimized by re-positioning said antenna feed elements with a re-positioning mechanism configured to alter positions of said antenna feed elements via an iterative optimization processing to meet multiple constraints to said radiation patterns for said both receiving and transmission functions concurrently to shape said radiation patterns, wherein said beam forming networks comprise a receiving beam forming network configured to combine multiple first inputs from said antenna feed elements into at least a first output, and a transmission beam forming network configured to divide a second input into multiple second outputs to said antenna feed elements.

2. The antenna system of claim 1, wherein said constraints comprise a minimum gain of a beam peak.

3. The antenna system of claim 1, wherein said constraints comprise a maximum gain of a beam null.

4. The antenna system of claim 1, wherein said element weightings are fixed.

5. The antenna system of claim 1 further comprising a reflector illuminated by said antenna feed elements.

6. The antenna system of claim 5, wherein one of said antenna feed elements is on a focal plane of said reflector.

7. The antenna system of claim 5, wherein one of said antenna feed elements is defocused away from a focal plane of said reflector.

8. The antenna system of claim 1, wherein said constraints comprise a direction of a beam peak.

9. The antenna system of claim 1, wherein said constraints comprise a direction of a beam null.

10. An antenna system comprising:

multiple antenna feed elements;

and multiple beam forming networks with multiple element weightings associated with the multiple feed elements configured to produce radiation patterns for a receiving function configured to be optimized by re-positioning said antenna feed elements with a re-positioning mechanism configured to alter positions of said antenna feed elements via an iterative optimization processing to meet multiple constraints to said radiation patterns for said receiving function to shape said radiation patterns, wherein said beam forming networks comprise a receiving beam forming network configured to combine multiple first inputs from said antenna feed elements into at least a first output.

11. The antenna system of claim 10, wherein said constraints comprise a minimum gain of a beam peak.

12. The antenna system of claim 10, wherein said constraints comprise a maximum gain of a beam null.

13. The antenna system of claim 10, wherein said constraints comprise a direction of a beam peak.

14. The antenna system of claim 10, wherein said constraints comprise a direction of a beam null.

15. An antenna system comprising:

multiple antenna feed elements;

and multiple beam forming networks with multiple element weightings associated with the multiple feed elements configured to produce radiation patterns for a transmission function configured to be optimized by re-positioning said antenna feed elements with a re-positioning mechanism configured to alter positions of said antenna feed elements via an iterative optimization processing to meet multiple constraints to said radiation patterns for said transmission function to shape said radiation patterns, wherein said beam forming networks comprise a transmission beam forming network configured to divide a second input into multiple second outputs to said antenna feed elements.

16. The antenna system of claim 15, wherein said constraints comprise a minimum gain of a beam peak.

17. The antenna system of claim 15, wherein said constraints comprise a maximum gain of a beam null.

18. The antenna system of claim 15, wherein said constraints comprise a direction of a beam peak.

19. The antenna system of claim 15, wherein said constraints comprise a direction of a beam null.

* * * * *